US011742577B2

(12) United States Patent
Mitchelson et al.

(10) Patent No.: US 11,742,577 B2
(45) **Date of Patent: *Aug. 29, 2023**

(54) FEED SYSTEMS FOR MULTI-BAND PARABOLIC REFLECTOR MICROWAVE ANTENNA SYSTEMS

(71) Applicant: CommScope Technologies LLC, Hickory, NC (US)

(72) Inventors: Craig Mitchelson, Cumbernauld (GB); Ronald J. Brandau, Homer Glen, IL (US); Thomas C. Tulloch, Aberdour (GB); Griogair Whyte, Larbert (GB)

(73) Assignee: CommScope Technologies LLC, Hickory, NC (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/865,602

(22) Filed: Jul. 15, 2022

(65) Prior Publication Data

US 2022/0352631 A1 Nov. 3, 2022

Related U.S. Application Data

(62) Division of application No. 17/261,142, filed as application No. PCT/US2019/055166 on Oct. 8, 2019, now Pat. No. 11,424,538.

(Continued)

(51) Int. Cl.
*H01Q 5/47* (2015.01)
*H01Q 19/19* (2006.01)

(Continued)

(52) U.S. Cl.
CPC ..... *H01Q 5/47* (2015.01); *H01Q 13/0258* (2013.01); *H01Q 15/16* (2013.01); *H01Q 19/136* (2013.01); *H01Q 19/193* (2013.01)

(58) Field of Classification Search
CPC ..... H01Q 5/47; H01P 1/161
See application file for complete search history.

(56) References Cited

U.S. PATENT DOCUMENTS 3,622,884 A * 11/1971 Kent ..... H01Q 13/0258 361/728
4,797,681 A * 1/1989 Kaplan ..... H01Q 13/0258 333/137

(Continued)

FOREIGN PATENT DOCUMENTS

CN 1337077 A 2/2002
CN 1886863 A 12/2006

(Continued)

OTHER PUBLICATIONS

"Extended European Search Report for European Application No. 198711475.0, dated May 13, 2022, 8 pages".

(Continued)

*Primary Examiner* — Ab Salam Alkassim, Jr.
(74) *Attorney, Agent, or Firm* — Myers Bigel, P.A.

(57) ABSTRACT

Microwave antenna systems include a parabolic reflector antenna having a feed bore and a feed assembly. The feed assembly includes a coaxial waveguide structure that extends through the feed bore, a sub-reflector, and a first dielectric block that is positioned between the coaxial waveguide structure and the sub-reflector. The coaxial waveguide structure includes a central waveguide and an outer waveguide that circumferentially surrounds the central waveguide. One of the central waveguide and the outer waveguide extends further from the feed bore towards the sub-reflector than the other of the central waveguide and the outer waveguide.

20 Claims, 8 Drawing Sheets

Related U.S. Application Data

(60) Provisional application No. 62/744,304, filed on Oct. 11, 2018.

(51) Int. Cl.
*H01Q 15/16* (2006.01)
*H01Q 13/02* (2006.01)
*H01Q 19/13* (2006.01)

(56) References Cited

U.S. PATENT DOCUMENTS 4,903,037 A * 2/1990 Mitchell ..... H01P 1/165 333/21 A
4,963,878 A 10/1990 Kildal
5,162,808 A 11/1992 Kim
5,461,394 A * 10/1995 Weber ..... H01Q 13/0258 343/837
5,635,944 A 6/1997 Weinstein et al.
5,793,334 A 8/1998 Anderson et al.
5,818,396 A * 10/1998 Anderson ..... H01Q 19/08 343/785
5,907,309 A * 5/1999 Anderson ..... H01Q 5/47 333/248
6,031,434 A 2/2000 Tatomir et al.
6,081,170 A * 6/2000 Enokuma ..... H01Q 5/47 333/21 A
6,137,449 A * 10/2000 Kildal ..... H01Q 1/42 343/781 CA
6,225,957 B1 5/2001 Yamaguchi
6,452,561 B1 9/2002 West et al.
6,496,084 B1 12/2002 Monte et al.
6,720,932 B1 4/2004 Flynn et al.
8,077,103 B1 * 12/2011 Acosta ..... H01Q 15/04 343/756
8,089,415 B1 1/2012 West
8,230,581 B1 7/2012 Wilcoxon et al.
8,786,508 B1 * 7/2014 Edwards ..... H01Q 5/47 343/781 R
8,963,791 B1 * 2/2015 Edwards ..... H01Q 13/0216 343/781 R
11,367,958 B2 6/2022 Tuau et al.
11,489,259 B2 * 11/2022 Mitchelson ..... H01P 1/171
2001/0011933 A1 8/2001 Enokuma
2002/0097111 A1 7/2002 Holden et al.
2002/0175875 A1 * 11/2002 Verstraeten ..... H01Q 5/47 343/786
2004/0257290 A1 * 12/2004 Gothard ..... H01Q 19/19 343/781 R
2005/0017916 A1 1/2005 Lewry et al.
2005/0083241 A1 4/2005 Zarro et al.
2005/0088355 A1 4/2005 Kralovec et al.
2005/0099350 A1 * 5/2005 Gothard ..... H01Q 19/193 343/781 CA
2005/0099351 A1 * 5/2005 Gothard ..... H01Q 5/47 343/781 CA
2006/0170600 A1 8/2006 Korva
2006/0262021 A1 11/2006 Matsui
2008/0117116 A1 5/2008 Stroes et al.
2008/0297428 A1 * 12/2008 Wu ..... H01Q 5/47 343/786
2009/0179809 A1 7/2009 Jan
2011/0181479 A1 7/2011 Martin et al.
2011/0291903 A1 12/2011 Shea et al.
2012/0007792 A1 * 1/2012 Brandau ..... H01Q 1/00 343/907
2013/0057444 A1 * 3/2013 Brandau ..... H01Q 19/19 343/781 CA
2015/0054596 A1 * 2/2015 Rogers ..... H01Q 5/47 333/125
2015/0097747 A1 * 4/2015 Hwang ..... H01Q 13/0258 343/785
2016/0049733 A1 2/2016 Dunning
2016/0126638 A1 5/2016 Brandau
2017/0207541 A1 * 7/2017 Wu ..... H01Q 5/55
2019/0006770 A1 1/2019 Mizzoni et al.
2019/0013587 A1 * 1/2019 Gendron ..... H01P 1/172
2019/0020112 A1 * 1/2019 Luo ..... H01Q 5/47
2019/0207321 A1 * 7/2019 Hollenbeck ..... H01Q 5/47
2020/0144765 A1 * 5/2020 Mahon ..... H01Q 19/136
2020/0153105 A1 * 5/2020 Lu ..... H01Q 13/0208
2020/0185835 A1 6/2020 Giusto
2020/0212573 A1 7/2020 Syed et al.
2020/0280135 A1 9/2020 Biancotto et al.
2020/0313296 A1 10/2020 Mitchelson et al.
2020/0403312 A1 * 12/2020 Guan ..... H01Q 5/378
2021/0126376 A1 * 4/2021 Tuau ..... H01Q 15/16
2021/0265740 A1 8/2021 Mitchelson et al.
2021/0280983 A1 9/2021 Hyman et al.
2021/0384623 A1 12/2021 Tulloch et al.
2022/0021111 A1 1/2022 Naym et al.
2022/0094066 A1 3/2022 Lebayon

FOREIGN PATENT DOCUMENTS

CN 201285802 Y 8/2009
CN 104167612 A 11/2014
EP 1004151 B1 12/2006
WO 9910950 A2 3/1999
WO 2018057824 A1 3/2018
WO 2018133071 A1 7/2018

OTHER PUBLICATIONS

"International Search Report and Written Opinion of the International Searching Authority", international Application No. PCT/US2019/055166, Feb. 10, 2020, 12 pp.

* cited by examiner

FEED SYSTEMS FOR MULTI-BAND PARABOLIC REFLECTOR MICROWAVE ANTENNA SYSTEMS

CROSS-REFERENCE TO RELATED APPLICATION

The present application claims priority under 35 U.S.C. § 120 as a divisional of U.S. patent application Ser. No. 17/261,142, filed Jan. 18, 2021, which in turn is a 35 U.S.C. § 371 national stage application of PCT Application No. PCT/US2019/055166, filed Oct. 8, 2019, which itself claims priority under 35 U.S.C. § 119 to U.S. Provisional Application Ser. No. 62/744,304, filed Oct. 11, 2018, the entire contents of each of which are incorporated herein by reference in their entireties. The above-referenced PCT Application was published in the English language as International Publication No. WO 2020/076808 A1 on Apr. 16, 2020.

BACKGROUND

The present invention relates generally to microwave communications and, more particularly, to antenna systems used in microwave communications systems.

Microwave transmission refers to the transmission of information or energy by electromagnetic waves whose wavelengths are measured in units of centimeters. These electromagnetic waves are called microwaves. The "microwave" portion of the radio spectrum ranges across a frequency band of approximately 1.0 GHz to approximately 300 GHz. These frequencies correspond to wavelengths in a range of approximately 30 centimeters to 0.1 centimeters.

Microwave communication systems may be used for point-to-point communications because the small wavelength of the electromagnetic waves may allow relatively small sized antennas to direct the electromagnetic waves into narrow beams, which may be pointed directly at a receiving antenna. This ability to form narrow antenna beams may allow nearby microwave communications equipment to use the same frequencies without interfering with each other as lower frequency electromagnetic wave systems may do. In addition, the high frequency of microwaves may give the microwave band a relatively large capacity for carrying information, as the microwave band has a bandwidth approximately thirty times the bandwidth of the entirety of the radio spectrum that is at frequencies below the microwave band. Microwave communications systems, however, are limited to line of sight propagation as the electromagnetic waves cannot pass around hills, mountains, structures, or other obstacles in the way that lower frequency radio waves can.

Parabolic reflector antennas are often used to transmit and receive microwave signals. FIG. 1 is a partially-exploded, rear perspective view of a conventional microwave antenna system 10 that uses a parabolic reflector antenna. As shown in FIG. 1, the antenna system 10 includes a parabolic reflector antenna 20, a feed assembly 30 and a hub 50. The parabolic reflector antenna 20 may comprise, for example, a dish-shaped structure that is formed of metal or that has a metal inner surface (the inner metal surface of antenna 20 is not visible in FIG. 1). The hub 50 may be used to mount the parabolic reflector antenna 20 on a mounting structure (not shown) such as a pole, antenna tower, building or the like. The hub 50 may be mounted on the rear surface of the parabolic reflector antenna 20 by, for example, mounting screws.

The hub 50 may include a hub adapter 52. A transition element 54 may be received within the hub adapter 52. The transition element 54 may be designed to efficiently launch RF signals received from, for example, a radio (not shown) into the feed assembly 30. The transition element 54 may comprise, for example, a rectangular-to-circular waveguide transition that is impedance matched for a specific frequency band. The transition element 54 that is mounted in the hub adapter 52 may be part of a feed assembly interface 60 that provides a communication path between one or more radios and the feed assembly 30. The feed assembly interface 60 may include additional elements such as, for example, an orthomode transducer ("OMT") (not shown) that connects a pair of radios that transmit orthogonally polarized signals to the feed assembly 30. The feed assembly 30 and the feed assembly interface 60 may together comprise a feed system for the microwave antenna system 10.

A feed bore 22 in the form of an opening is provided at the middle (bottom) of the dish-shaped antenna 20. The hub adapter 52 may be received within this feed bore 22. The transition element 54 includes a bore 56 that receives the feed assembly 30. The feed assembly 30 may comprise, for example, a circular waveguide 32 and a sub-reflector 40. The circular waveguide 32 may have a tubular shape and may be formed of a metal such as, for example, aluminum. When the feed assembly 30 is mounted in the hub adapter 52 and the hub adapter 52 is received within the feed bore 22, a base of the circular waveguide 32 may be proximate the feed bore 22, and a distal end of the circular waveguide 32 and the sub-reflector 40 may be in the interior of the parabolic reflector antenna 20. A low-loss dielectric block 34 may be inserted into the distal end of the circular waveguide 32. A distal end of the low-loss dielectric block 34 may have, for example, a stepped generally cone-like shape. The sub-reflector 40 may be mounted on the distal end of the dielectric block 34. In some cases, the sub-reflector 40 may be a metal layer that is sprayed, brushed, plated or otherwise formed on a surface of the dielectric block 34. In other cases, the sub-reflector 40 may comprise a separate element that is attached to the dielectric block 34. The sub-reflector 40 is typically made of metal and is positioned at a focal point of the parabolic reflector antenna 20. The sub-reflector 40 is designed to reflect microwave energy emitted from the circular waveguide 32 onto the interior of the parabolic reflector antenna 20, and to reflect and focus microwave energy that is incident on the parabolic reflector antenna 20 into the distal end of the circular waveguide 32.

Microwave antenna systems have been provided that operate in multiple frequency bands. For example, the UMX® microwave antenna systems sold by CommScope, Inc. of Hickory, N.C. operate in two separate microwave frequency bands. These antennas include multiple waveguide feeds, each of which directly illuminates a parabolic reflector antenna. Other dual-band designs have been proposed where a first feed directly illuminates a parabolic reflector antenna and a second feed illuminates the parabolic reflector antenna via a sub-reflector. U.S. Pat. No. 6,137,449 and PCT Patent Publication No. WO 2018/057824 also disclose dual-band reflector antenna designs that include coaxial waveguide structures.

SUMMARY

Pursuant to embodiments of the present invention, microwave antenna systems are provided that include a parabolic reflector antenna having a feed bore and a feed assembly. The feed assembly includes a coaxial waveguide structure that extends through the feed bore, the coaxial waveguide structure including a central waveguide and an outer waveguide that circumferentially surrounds the central waveguide, a sub-reflector, and a first dielectric block positioned between the coaxial waveguide structure and the sub-reflector. One of the central waveguide and the outer waveguide extends further from the feed bore towards the sub-reflector than the other of the central waveguide and the outer waveguide.

In some embodiments, the central waveguide may extend further from the feed bore towards the sub-reflector than the outer waveguide.

In some embodiments, the first dielectric block may be mounted in a distal end of the central waveguide.

In some embodiments, the microwave antenna system may further include a second dielectric block positioned between the coaxial waveguide structure and the sub-reflector, the second dielectric block being separate from the first dielectric block.

In some embodiments, the second dielectric block may be mounted in a distal end of the outer waveguide.

In some embodiments, the feed assembly may further include a low-pass filter within the outer waveguide.

In some embodiments, the second dielectric block may include a central opening, and the central waveguide may extend through the central opening.

In some embodiments, the first dielectric block may be received within a distal end of the central waveguide and may extend at least part of the way through the central opening in the second dielectric block.

In some embodiments, the second dielectric block may comprise an annular disk having a rearwardly-extending annular flange.

In some embodiments, the first dielectric block may extend from a distal end of the coaxial waveguide structure, and the sub-reflector may be mounted on the first dielectric block.

In some embodiments, the outer waveguide may comprise a multi-piece outer waveguide.

In some embodiments, the microwave antenna system may further include a microwave energy absorber mounted on the sub-reflector opposite the coaxial waveguide structure.

In some embodiments, the outer waveguide may extend further from the feed bore towards the sub-reflector than the central waveguide.

In some embodiments, the microwave antenna system may further include a feed assembly interface that includes a central waveguide extension that is coupled to the central waveguide, an outer waveguide extension that is coupled to the outer waveguide, a first rectangular waveguide, a second rectangular waveguide, the first and second rectangular waveguides coupled to the outer waveguide extension at respective first and second longitudinal positions along the outer waveguide extension, and at least one shorting element that extends through the outer waveguide extension to contact an outer surface of the central waveguide extension, the at least one shorting element disposed between the first and second longitudinal positions.

In some embodiments, the feed assembly interface may further include a polarization rotator that extends into the outer waveguide extension.

In some embodiments, the polarization rotator may comprise at least one angled pin that is angled at a 45 degree angle with respect to a horizontal plane defined by the bottom of the first rectangular waveguide.

In some embodiments, the at least one shorting element may comprise a plurality of shoring pins, the feed assembly interface further comprising one or more biasing elements that bias the shorting pins against the outer surface of the central waveguide extension.

In some embodiments, the one or more biasing elements may comprise a plurality of springs that spring load the respective shorting pins against the outer surface of the central waveguide extension.

In some embodiments, multiple of the springs may be mounted between a mounting plate and respective ones of the shorting pins.

In some embodiments, the one or more biasing elements may be a compression block.

In some embodiments, the feed assembly interface may further include a polarization rotator biasing element that biases the angled pin against the central waveguide extension.

Pursuant to further embodiments of the present invention, microwave antenna systems are provided that include a parabolic reflector antenna having a feed bore and a feed assembly. The feed assembly includes a coaxial waveguide structure that extends through the feed bore, the coaxial waveguide structure including a central waveguide and an outer waveguide that circumferentially surrounds the central waveguide, a first dielectric block coupled to a distal end of the central waveguide, a second dielectric block that is separate from the first dielectric block and that circumferentially surrounds a portion of the first dielectric block, the second dielectric block coupled to the outer waveguide, and a sub-reflector, wherein the first dielectric block is positioned along a first communications path that extends between the central waveguide and the sub-reflector and the second dielectric block is positioned along a second communications path that extends between the outer waveguide and the sub-reflector.

In some embodiments, the central waveguide may extend further from the feed bore towards the sub-reflector than the outer waveguide.

In some embodiments, the first dielectric block may be mounted in a distal end of the central waveguide In some embodiments, the feed assembly may further include a second dielectric block positioned between the coaxial waveguide structure and the sub-reflector.

In some embodiments, the second dielectric block may be mounted in a distal end of the outer waveguide.

In some embodiments, the second dielectric block may include a central opening, and the central waveguide may extend through the central opening in the second dielectric block.

In some embodiments, the first dielectric block may be received within a distal end of the central waveguide and may extend at least part of the way through the central opening in the second dielectric block.

In some embodiments, the microwave antenna system may further include a microwave energy absorber mounted on the sub-reflector opposite the coaxial waveguide structure.

In some embodiments, the microwave antenna system may further include the above-described feed assembly interface that includes a central waveguide extension that is coupled to the central waveguide, an outer waveguide extension that is coupled to the outer waveguide, a first rectangular waveguide, a second rectangular waveguide, the first and second rectangular waveguides coupled to the outer waveguide extension at respective first and second longitudinal positions along the outer waveguide extension, and at least one shorting element that extends through the outer waveguide extension to contact an outer surface of the central waveguide extension, the at least one shorting element disposed between the first and second longitudinal positions.

In some embodiments, the feed assembly interface may further include a polarization rotator that extends into the outer waveguide extension.

In some embodiments, the polarization rotator may comprise at least one angled pin that is angled at a 45 degree angle with respect to a horizontal plane defined by the bottom of the first rectangular waveguide.

In some embodiments, the at least one shorting element may comprise a plurality of shorting pins, the feed assembly interface further comprising one or more biasing elements that bias the shorting pins against the outer surface of the central waveguide extension.

In some embodiments, the one or more biasing elements may comprise a plurality of springs that spring load the respective shorting pins against the outer surface of the central waveguide extension.

In some embodiments, multiple of the springs may be mounted between a mounting plate and respective ones of the shorting pins.

In some embodiments, the one or more biasing elements may comprise a compression block.

Pursuant to still further embodiments of the present invention, microwave antenna systems are provided that include a parabolic reflector antenna having a feed bore, a feed assembly that includes a coaxial waveguide structure that extends in a longitudinal direction, the coaxial waveguide structure including a central waveguide and an outer waveguide that circumferentially surrounds the central waveguide, and a feed assembly interface. The feed assembly interface includes a central waveguide extension, an outer waveguide extension, a first rectangular waveguide, a second rectangular waveguide, the first and second rectangular waveguides coupled to the outer waveguide extension at respective first and second longitudinal positions along the outer waveguide extension, a plurality of shorting elements that extend through respective openings in the outer waveguide extension to contact an outer surface of the central waveguide extension, the shorting elements disposed between the first and second longitudinal positions, and at least one biasing element that biases the shorting elements against an outer wall of the central waveguide extension.

In some embodiments, the shorting elements may comprise pins.

In some embodiments, the at least one biasing element may comprise a plurality of springs.

In some embodiments, a separate spring may be provided for each pin.

In some embodiments, the at least one biasing element may comprise a compression block.

In some embodiments, the feed assembly interface may further include a polarization rotator that extends into the outer waveguide extension.

In some embodiments, the polarization rotator may comprise an angled pin that is angled with respect to the shorting elements.

In some embodiments, the angled pin may be angled at a 45 degree angle with respect to a horizontal plane defined by the bottom of the first rectangular waveguide.

In some embodiments, the feed assembly interface may further include a polarization rotator biasing element that biases the angled pin against the central waveguide extension.

In some embodiments, one of the central waveguide and the outer waveguide may extend further from the feed bore towards the sub-reflector than the other of the central waveguide and the outer waveguide.

In some embodiments, the central waveguide may extend further from the feed bore towards the sub-reflector than the outer waveguide.

In some embodiments, the feed assembly may further include a first dielectric block that is mounted in a distal end of the central waveguide, a sub-reflector, and a second dielectric block that is positioned between the coaxial waveguide structure and the sub-reflector.

In some embodiments, the second dielectric block may be mounted in a distal end of the outer waveguide, the second dielectric block includes a central opening, and the central waveguide extends through the central opening in the second dielectric block.

In some embodiments, the microwave antenna system may further include an intermediate waveguide positioned between the central waveguide and the outer waveguide.

In some embodiments, the microwave antenna system may further include a third dielectric block positioned between the coaxial waveguide structure and the sub-reflector, the third dielectric block being separate from the first and third dielectric blocks.

In some embodiments, the central waveguide may extend further from the feed bore towards the sub-reflector than the intermediate waveguide and the outer waveguide.

In some embodiments, the intermediate waveguide may extend further from the feed bore towards the sub-reflector than the outer waveguide.

DETAILED DESCRIPTION

Figure 1:
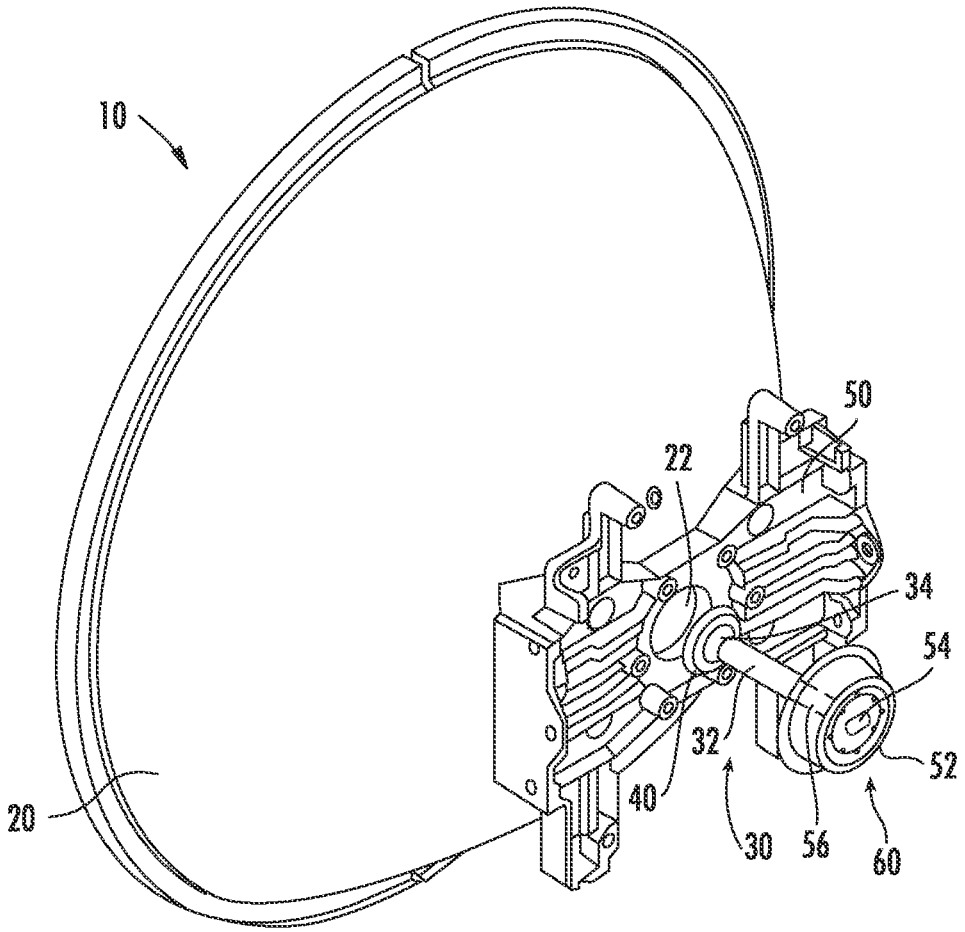
FIG. 1 is a partially-exploded, rear perspective view of a conventional microwave antenna system.

The feed system may be an important component of any microwave antenna system. When operating in transmit mode, the feed system of a parabolic microwave antenna system receives a microwave signal from a radio and should be designed to efficiently radiate this microwave signal onto the parabolic reflector antenna to produce a highly-focused pencil beam of microwave energy that propagates in a single direction. When operating in receive mode, the parabolic reflector reflects the microwave energy incident thereon to a focal point at an input of the feed system, and the feed system receives this focused microwave energy and passes it to the receive port of a radio.

Microwave antenna systems are typically required to perform within very stringent operating conditions, both to meet capacity requirements and to avoid excessive interference with nearby microwave antenna systems. Moreover, the microwave frequency bands that are in commercial use are fairly widely separated in frequency, and include a number of small bands in the 3.6-8.5 GHz and 10-13.25 GHz frequency ranges, as well as additional bands at 14.4-15.4 GHz, 17.7-19.7 GHz, 21.2-23.6 GHz, 24.2-26.5 GHz, 27.5-29.5 GHz, 31-33.4 GHz, 37-40 GHz, 40.5-43.5 GHz, 71-76 GHz, 81-86 GHz, 92-114 GHz and 130-174 GHz. As a result, most conventional parabolic microwave antenna systems only support service in one distinct microwave band or a set of contiguous ones of the smaller bands in the lower frequency ranges.

Pursuant to embodiments of the present invention, dual-band parabolic microwave antenna systems are provided that have improved feed systems. The feed systems can support transmission and reception in two distinct microwave frequency bands. These dual-band feed systems may include a dual-band feed assembly and a dual-band feed assembly interface.

The dual-band feed assemblies according to embodiments of the present invention may include one or more of a coaxial waveguide structure, first and second dielectric blocks, and a sub-reflector. The coaxial waveguide structure may include a central waveguide and an outer waveguide that circumferentially surrounds the central waveguide. The sub-reflector may be mounted forwardly of a distal end of the coaxial waveguide structure. The first and second dielectric blocks may be positioned between the coaxial waveguide structure and the sub-reflector. The sub-reflector may be configured to direct microwave signals between the parabolic reflector antenna and the coaxial waveguide structure. The signals in the higher frequency of the two frequency bands (the "high-band") may be fed to the parabolic reflector antenna through the central waveguide, and the signals in the lower frequency of the two frequency bands (the "low-band") may be fed to the parabolic reflector antenna through the outer waveguide. The central waveguide may have a generally circular transverse cross-section and the outer waveguide may have a generally annular transverse cross-section.

A distal end of the central waveguide may extend outwardly from the feed bore farther than the distal end of the outer waveguide. As a result, the central and outer waveguides of the coaxial waveguide structure may have different lengths. The first and second dielectric blocks, if provided, may be interposed between the coaxial waveguide and the sub-reflector. The first dielectric block may be inserted into a distal end of the central waveguide and may act as a mechanical support that mounts the sub-reflector at an appropriate distance from the coaxial waveguide structure. The first dielectric block may be impedance matched to the central waveguide so that it efficiently transfers the high-band microwave signals between the central waveguide and the sub-reflector. The second dielectric block may be inserted into a distal end of the outer waveguide and may be impedance matched to the outer waveguide so that it efficiently transfers the low-band microwave signals between the outer waveguide and the sub-reflector.

In some embodiments, the first dielectric block may have a generally circular or truncated cone shaped body and a narrower base that extends from the body that is received within the distal end of the central waveguide. The second dielectric block may comprise an annular ring having a rearwardly-extending annular flange. The second dielectric block may be mounted in a distal end of the outer waveguide. The second dielectric block may include a central opening, and the central waveguide and the base of the first dielectric block may extend through the central opening in the second dielectric block.

The feed system may further include a feed assembly interface that mates with the feed assembly. The feed assembly interface may include a central waveguide extension (which may be a rear portion of the central waveguide or a separate element that is coupled to the central waveguide), an outer waveguide extension (which may be a rear portion of the outer waveguide or a separate element that is coupled to the outer waveguide), and first and second rectangular waveguides that are coupled to the outer waveguide extension at respective first and second longitudinal positions along the outer waveguide extension. The feed assembly interface may also include one or more shorting elements (e.g., a plurality of shorting pins) that extend through the outer waveguide extension to contact an outer surface of the central waveguide extension, the shorting elements disposed between the first and second longitudinal positions. The feed assembly interface may also include one or more polarization rotators (e.g., pins that are angled at a 45 degree angle with respect to a horizontal plane defined by the bottom of the first rectangular waveguide) that extend into the outer waveguide extension.

One or more biasing elements may also be provided that bias the shorting elements against the outer surface of the central waveguide extension. The biasing elements may comprise, for example, a plurality of springs that spring load the respective shorting elements against the outer surface of the central waveguide extension or a compression block that performs the same function. The springs and/or the compression block may be mounted between a mounting plate and respective ones of the shorting elements. The feed assembly interface may further include polarization rotator biasing elements that bias the angled pins against the central waveguide extension.

Thus, pursuant to some embodiments of the present invention, microwave antenna systems are provided that include a parabolic reflector antenna having a feed bore and a feed assembly. The feed assembly includes a coaxial waveguide structure that extends through the feed bore, the coaxial waveguide structure including a central waveguide and an outer waveguide that circumferentially surrounds the central waveguide, a sub-reflector, and a first dielectric block that is positioned between the coaxial waveguide structure and the sub-reflector. One of the central waveguide and the outer waveguide extends further from the feed bore towards the sub-reflector than the other of the central waveguide and the outer waveguide.

Pursuant to further embodiments of the present invention, microwave antenna systems are provided that include a parabolic reflector antenna having a feed bore and a feed assembly. The feed assembly includes a coaxial waveguide structure that extends through the feed bore, the coaxial waveguide structure including a central waveguide and an outer waveguide that circumferentially surrounds the central waveguide, a first dielectric block coupled to a distal end of the central waveguide, a second dielectric block that is separate from the first dielectric block, the second dielectric block circumferentially surrounding a portion of the first dielectric block and coupled to the outer waveguide, and a sub-reflector. The first and second dielectric blocks are along respective communications paths between the central waveguide and the sub-reflector and between the outer waveguide and the sub-reflector.

Pursuant to still further embodiments of the present invention, microwave antenna systems are provided that include a parabolic reflector antenna having a feed bore, a feed assembly that includes a coaxial waveguide structure that extends in a longitudinal direction, and a feed assembly interface. The coaxial waveguide structure includes a central waveguide and an outer waveguide that circumferentially surrounds the central waveguide. The feed assembly interface includes a central waveguide extension, an outer waveguide extension, first and second rectangular waveguides that are coupled to the outer waveguide extension at respective first and second longitudinal positions along the outer waveguide extension, a plurality of shorting elements that extend through respective openings in the outer waveguide extension to contact an outer surface of the central waveguide extension, the shorting elements disposed between the first and second longitudinal positions and at least one biasing element that biases the shorting elements against an outer wall of the central waveguide.

The present invention will now be discussed in further detail with respect to FIGS. 2A-8, which illustrate example embodiments of the present invention.

Figure 2A:
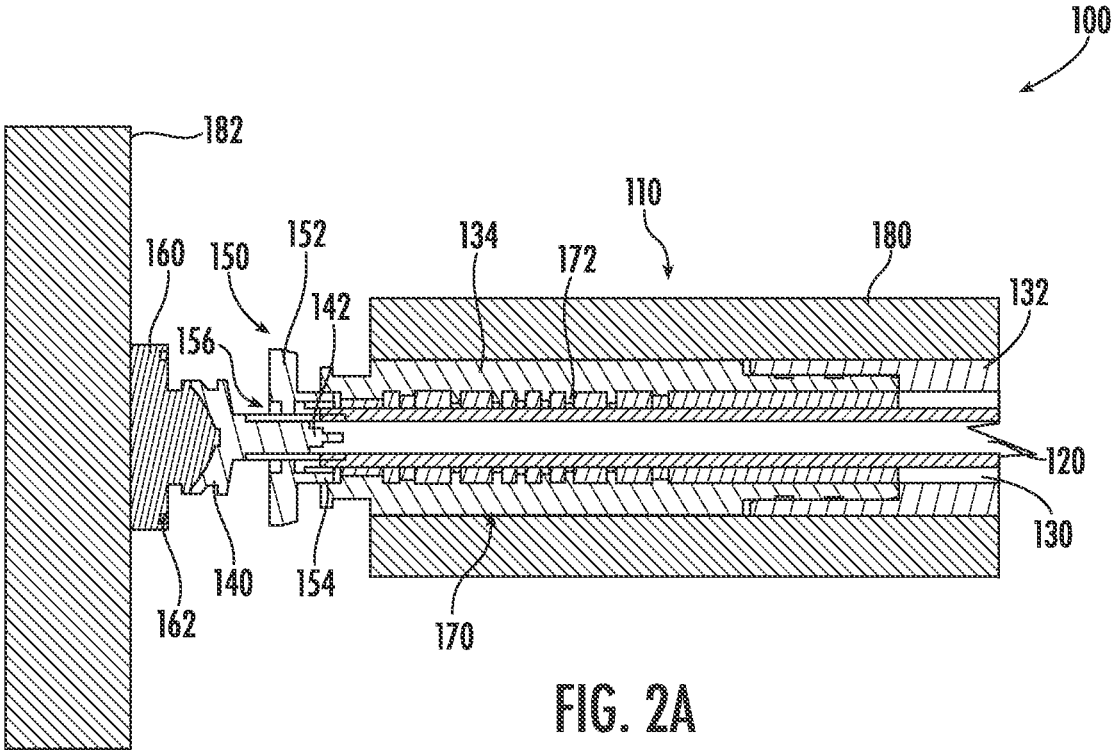
FIGS. 2A and 2B are a side sectional view and a perspective sectional view, respectively, of a coaxial feed assembly according to certain embodiments of the present invention.
Figure 2B:
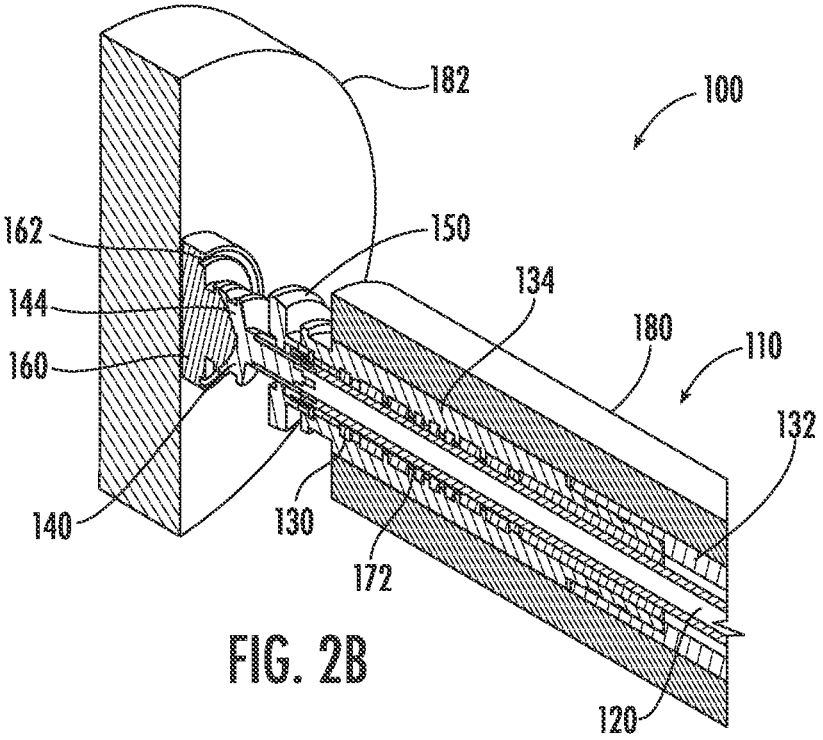

FIG. 2A is a side cross-sectional view of a dual-band coaxial feed assembly 100 according to embodiments of the present invention. FIG. 2B is a perspective cross-sectional view of the dual-band coaxial feed assembly 100 of FIG. 2A. The dual-band coaxial feed assembly 100 may be, for example, used in the microwave antenna system 10 of FIG. 1 in place of the conventional feed assembly 30.

As shown in FIGS. 2A and 2B, the dual-band coaxial feed assembly 100 includes a coaxial waveguide structure 110, first and second dielectric blocks 140, 150 and a sub-reflector 160. The coaxial waveguide structure 110 includes an inner or "central" waveguide 120 and an outer waveguide 130. A low-pass filter 170 may also be provided in the coaxial waveguide structure 110. The dual-band coaxial feed assembly 100 may extend through a feed bore of a parabolic reflector antenna such as the feed bore 22 of the parabolic reflector antenna 20 of FIG. 1. Any suitable hub and/or hub or hub adapter may be used to mount the feed assembly 100 in the feed bore 22 of the parabolic dish antenna 20. A feed assembly interface (e.g., the example feed assembly interface 200 of FIGS. 3A-3B) may be coupled to the dual-band coaxial feed assembly 100. The feed assembly interface may include one or more transition elements such as, for example, rectangular-to-circular waveguide transitions, or these transition elements may be integrated into the feed assembly 100. It will be appreciated that, in some embodiments, the rectangular-to-circular waveguide transition may be implemented simply as an interface between a rectangular waveguide and a circular waveguide.

Figure 7:
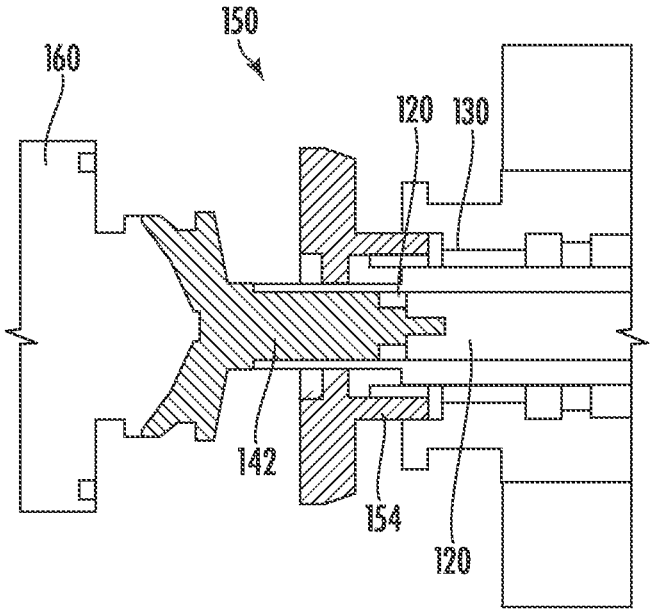
FIG. 7 is an enlarged side sectional view of a coaxial feed assembly according to further embodiments of the present invention.

The coaxial waveguide structure 110 may comprise, for example, an extruded coaxial aluminum waveguide that includes the central waveguide 120 and the outer waveguide 130. Other metal or conductive materials may be used. The outer waveguide 130 may circumferentially surround the central waveguide 120. The central waveguide 120 may have a generally circular transverse cross-section. The outer wall of the central waveguide 120 may be very thin. The central waveguide 120 may have smooth inner walls and may be designed to conduct microwave signals in the basic TE11 mode. In some embodiments, the central waveguide 120 may include steps, ridges or collars (collectively referred to herein as "protrusions") 122 which may be configured to (1) improve the return loss of the central waveguide 120, (2) improve the isolation of the central waveguide 120 with respect to the microwave signals that pass through the outer waveguide 130, and/or (3) reduce higher order mode propagation in the central waveguide 120. While such protrusions 122 are not included in the central waveguide 120 illustrated in FIGS. 2A-2B, FIG. 7 illustrates a portion of a modified version of coaxial waveguide structure 110 which includes a central waveguide 120' that has a protrusion 122 in the form of a metal collar extending inwardly from the outer wall of the central waveguide 120'. The collar 122 may help reduce or control the propagation of higher order modes in the central waveguide 120', and may also improve the return loss performance of the central waveguide 120'. The collar 122 is positioned at the location where the base 142 of the first dielectric block 140 is received within the central waveguide 120'. It will be appreciated that the protrusions 122 may be integrated into the central waveguide 120 and/or may be separate elements that are mounted in the central waveguide 120.

The inner diameter of the central waveguide 120 may be, for example, between $0.6\lambda_1$ and $1.2\lambda_1$ in some embodiments, where $\lambda_1$ is the wavelength corresponding to the center frequency of the high-band. It will be appreciated that the high-band may, in some cases, have a transmit sub-band and a receive sub-band. In such cases, the center frequency of the high-band is defined as the halfway point between the lowest frequency of the lower frequency sub-band and the highest frequency of the higher frequency sub-band. The central waveguide 120 may be sized so that it will not support propagation of the low-band signals (i.e., the central waveguide 120 rejects any signals in the low-band incident thereon).

The outer waveguide 130 may have an annular transverse cross-section. The distance between the outer wall of the central waveguide 120 and the inner wall of the outer waveguide 130 may be, for example, a fraction of $\lambda_2$ in some embodiments, where $\lambda_2$ is the wavelength corresponding to the center frequency of the low-band. The outer waveguide 130 may include a low-pass filter 170, as will be discussed in greater detail below. In some embodiments, the outer waveguide 130 may include steps, ridges or collars ("protrusions") 136 which may be configured to (1) improve the return loss of the outer waveguide 130, (2) improve the isolation of the outer waveguide 130 with respect to the microwave signals that pass through the central waveguide 120, and/or (3) reduce higher order mode propagation in the outer waveguide 130. The protrusions 136 may be integrated into the outer waveguide 130 or may be separate elements that are mounted in the outer waveguide 130. The protrusions 136 are separate from any protrusions included in the low-pass filter 170.

As shown in FIGS. 2A-2B, the central waveguide 120 may extend further from the feed bore 22 of parabolic antenna 20 (or any other suitable parabolic antenna) toward the sub-reflector 160 than does the outer waveguide 130. It will be appreciated, however, that in other embodiments the outer waveguide 130 may extend further from the feed bore 22 towards the sub-reflector 160 than does the central waveguide 120. As will be discussed below, configuring one of the central waveguide 120 and the outer waveguide 130 to extend closer to the sub-reflector 160 than the other may facilitate mounting the first and second dielectric blocks 140, 150 on the coaxial waveguide structure 110.

As noted above, the dual-band coaxial feed assembly 100 further includes first and second dielectric blocks 140, 150. Each of the dielectric blocks 140, 150 may be formed of a low-loss dielectric material. The first dielectric block 140 may have a generally circular or truncated cone shaped body 144 and a narrower base 142 that extends from the body 144. The base 142 of the first dielectric block 140 may be inserted into a distal end of the central waveguide 120. The first dielectric block 140 may be impedance matched with the central waveguide 120 so that it efficiently transfers the high-band microwave signals between the central waveguide 120 and the sub-reflector 160. As shown in FIGS. 2A-2B, in some embodiments, the first dielectric block 140 may provide a mechanical support for mounting the sub-reflector 160 at an appropriate distance from the distal ends of the central and outer waveguides 120, 130. In other embodiments, the sub-reflector 160 may be mounted on the second dielectric block 150, mounted on a separate support structure (e.g., on the radome), or mounted on a low-loss dielectric support that is attached to first and/or second dielectric blocks 140, 150. The base 142 of the first dielectric block 140 may have a stepped or tapered profile for purposes of impedance matching the first dielectric support 140 to the central waveguide 120 to reduce or minimize reflections.

The second dielectric block 150 may be inserted into a distal end of the outer waveguide 130. The second dielectric block 150 may be impedance matched with the outer waveguide 130 so that it efficiently transfers the low-band microwave signals between the outer waveguide 130 and the sub-reflector 160. The second dielectric block 150 may have a body portion 152 that may have the shape of an annular disk in some embodiments. An annular flange 154 may extend rearwardly from the body portion 152. The annular flange 154 may be received within the distal end of the outer waveguide 130. The annular flange 154 and the annular body 152 define an opening 156 that extends through the second dielectric block 150. The distal end of the central waveguide 120 may extend at least part of the way through the opening 156 in the second dielectric block 150. Since the base 142 of the first dielectric block 140 extends into the distal end of the central waveguide 120, the base of the first dielectric block 140 likewise may extend at least part of the way through the opening 156 in the second dielectric block 150.

The second dielectric block 150 may be configured to direct the low-band microwave energy exiting the outer waveguide 130 onto the parabolic reflector 20. The second dielectric block 150 may likewise be configured to direct the low-band microwave energy that is focused by the parabolic antenna 20 onto the sub-reflector 160 into the outer waveguide 130. The second dielectric block 150 may comprise a lens in some embodiments that focuses the low-band microwave energy in one direction (e.g. along the transmit path) and spreads the low-band microwave energy in the other direction (e.g., along the receive path)

The sub-reflector 160 is mounted on the distal end of the first dielectric block 140. The sub-reflector 160 may be mounted at the focal point of the parabolic reflector antenna 20 (see FIG. 1). The sub-reflector 160 may comprise, for example, a machined metal sub-reflector or a molded sub-reflector 160. In some embodiments, the sub-reflector 160 may be formed entirely of metal, while in other embodiments the sub-reflector 160 may comprise metal that is sprayed, brushed, plated or otherwise deposited or formed on a dielectric substrate such as, for example, a distal end of the first dielectric block 140 or a distal end of the second dielectric block 150. The sub-reflector 160 may have a circular cross-section (when the cross-section is taken in a direction transverse to the longitudinal dimension of the central waveguide 120). The diameter of the circular cross-section of the sub-reflector 160 may be greater than the diameter of the circular cross-section of the coaxial waveguide structure 110.

The sub-reflector 160 may have one or more circular grooves or rings 162 that are formed in a rear surface thereof that faces the coaxial waveguide structure 110. In the depicted embodiment, the sub-reflector 160 includes one circular ring 162 that is formed near the periphery of the rear surface of the sub-reflector 160. In other embodiments, a plurality of circular grooves or rings 162 may be provided that have different diameters to form two or more concentric grooves/rings 162. The groove 162 included in the depicted embodiment will primarily be illuminated by the low-band signals that are passed through the outer waveguide 130. The groove 162 may control and/or focus the low-band energy onto the sub-reflector 160 in a desired fashion.

While a one-piece sub-reflector 160 is depicted in FIGS. 2A-2B, it will be appreciated that in other embodiments the sub-reflector may include multiple separate pieces.

As is further shown in FIGS. 2A-2B, the feed assembly 100 may include one or more microwave energy absorbers. In the depicted embodiment, a first microwave energy absorber 180 is provided that surrounds the outer waveguide 130 and a second microwave energy absorber 182 is mounted on the front of the sub-reflector 160. The first microwave energy absorber 180 may have a circular cylinder shape with an opening extending along a longitudinal axis of the cylinder that receives the coaxial waveguide structure 110. The first microwave energy absorber 180 may include a longitudinal slit that allows the first microwave energy absorber 180 to easily be mounted onto the coaxial waveguide structure 110. The second microwave energy absorber 182 may comprise a circular disk of material that is mounted on the sub-reflector 160. The first and second microwave energy absorbers 180, 182 may absorb microwave energy that impinges thereon so that such microwave energy is not reflected in undesired directions. While microwave energy absorbers 180, 182 are shown in the embodiment of FIGS. 2A-2B, it will be appreciated that in other embodiments the microwave energy absorbers 180, 182 may be replaced with dielectrics, ferrites and/or choke rings that may also reduce, or remove microwave energy being reflected in undesired directions and may improve impedance matching of the feed.

As noted above, the central waveguide 120 may be sized so that it supports propagation of the high-band signals while rejecting propagation of the low-band signals. Thus, any received low frequency energy that is reflected by the sub-reflector 160 toward the central waveguide 120 will generally not propagate through the central waveguide 120 to the high-band radio(s). The high frequency signals, however, may generally propagate through both the central waveguide 120 and the outer waveguide 130. Accordingly, the outer waveguide 130 may include a low-pass filter 170 that may reduce or prevent high frequency energy that is incident on the outer waveguide 130 from propagating through the outer waveguide 130 to the low-band radios. The low-pass filter 170 may be implemented as a series of annular ridges 172 that project inwardly from the outer sidewall of the outer waveguide 130. Other low-band filter structures or pass-band filters may be used in other embodiments.

In practice, it may be difficult to control tolerances and/or to control the concentricity of the annular ridges 172 that are used to implement the low-pass filter 170, particularly on relatively long coaxial waveguide structures that may be used in antennas having larger and/or deeper parabolic reflectors. Thus, the coaxial waveguide structure 110 may be implemented as a multi-piece assembly to improve performance and/or simplify manufacturing. In particular, as shown in FIGS. 2A-2B, the outer waveguide portion 130 of the coaxial waveguide structure 110 is implemented as a two-piece structure that includes an outer boom portion 132 and a low-pass filter portion 134. In the depicted embodiment, the low-pass filter portion 134 is farther from the feed bore 22 than is the outer boom portion 132. Implementing the low-pass filter 170 in a low-pass filter portion 134 that is separate from the outer boom portion 132 may have several advantages. First, the use of a multi-piece coaxial waveguide structure 110 allows the structure to be divided into a long, but simple, outer boom portion 132 and a short, but complex, low-pass filter portion 134. This may make it easier to control and achieve tight tolerances and concentricity. Moreover, implementing the low-pass filter 170 using annular ridges 172 that project inwardly from the outer sidewall of the outer waveguide 130 simplifies manufacturing.

As discussed above, many of the microwave frequency bands that are in commercial use are widely separated in frequency. In some embodiments, dual-band microwave feed assemblies may support two microwave frequency bands where the center frequency of the high-band is at least 1.25 times greater than the center frequency of the low-band. In other embodiments, the dual-band microwave feed assemblies may support two microwave frequency bands where the center frequency of the high-band is at least 1.4 times greater than the center frequency of the low-band. In still other embodiments, the dual-band microwave feed assemblies may support two microwave frequency bands where the center frequency of the high-band is at least twice the center frequency of the low-band. In yet other embodiments, the dual-band microwave feed assemblies may support two microwave frequency bands where the center frequency of the high-band is at least three times the center frequency of the low-band.

Numerous modifications may be made to the dual-band coaxial feed assembly 100 without departing from the scope of the present invention. For example, in further embodiments, other low-pass filter structures could be used in place of the series of annular ridges 136. As another example, in further embodiments, another coaxial waveguide could be added that surrounds the outer waveguide to provide a tri-band feed structure. Other shaped central and outer waveguides may be used in some embodiments such as, for example, waveguides with square as opposed to circular cross-sections. It will also be appreciated that the outer waveguide 130 may be configured as the high-band waveguide and the central waveguide 120 may be configured as the low-band waveguide in other embodiments. In such embodiments, other elements would be rearranged accordingly (e.g., the low-pass filter would be within the central waveguide 120, etc.).

While not shown in the figures, it will be appreciated that the microwave antenna systems disclosed herein may include other conventional components such as radomes, RF shields, antenna mounts and the like. If RF shields and/or radomes are provided, the shields and radomes may be broadband RF shields and radomes. In particular, the radomes may be designed to efficiently pass microwave energy in both the low-band and high-band microwave frequency bands, and the RF shields may be designed to reflect/block/absorb microwave signals in both microwave frequency bands. It will also be appreciated that while the feed assemblies have been primarily described above with respect to signals that are transmitted therethrough, the feed assemblies are bi-directional and are likewise used to received low-band and high-band microwave signals that are incident on parabolic reflector antennas that include the feed assemblies and to pass those signals to respective low-band and high-band radios.

Embodiments of the present invention also encompass feed assembly interfaces that may be used to pass microwave signals between the coaxial feed assemblies according to embodiments of the present invention and microwave radios.

Figure 3A:
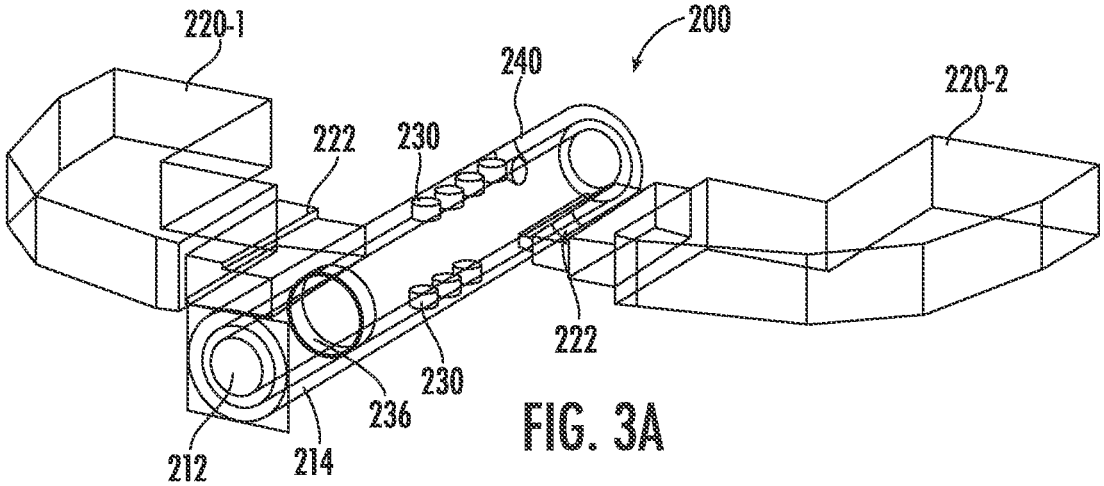
FIG. 3A is a schematic perspective phantom view of a feed assembly interface according to further embodiments of the present invention.
Figure 3B:
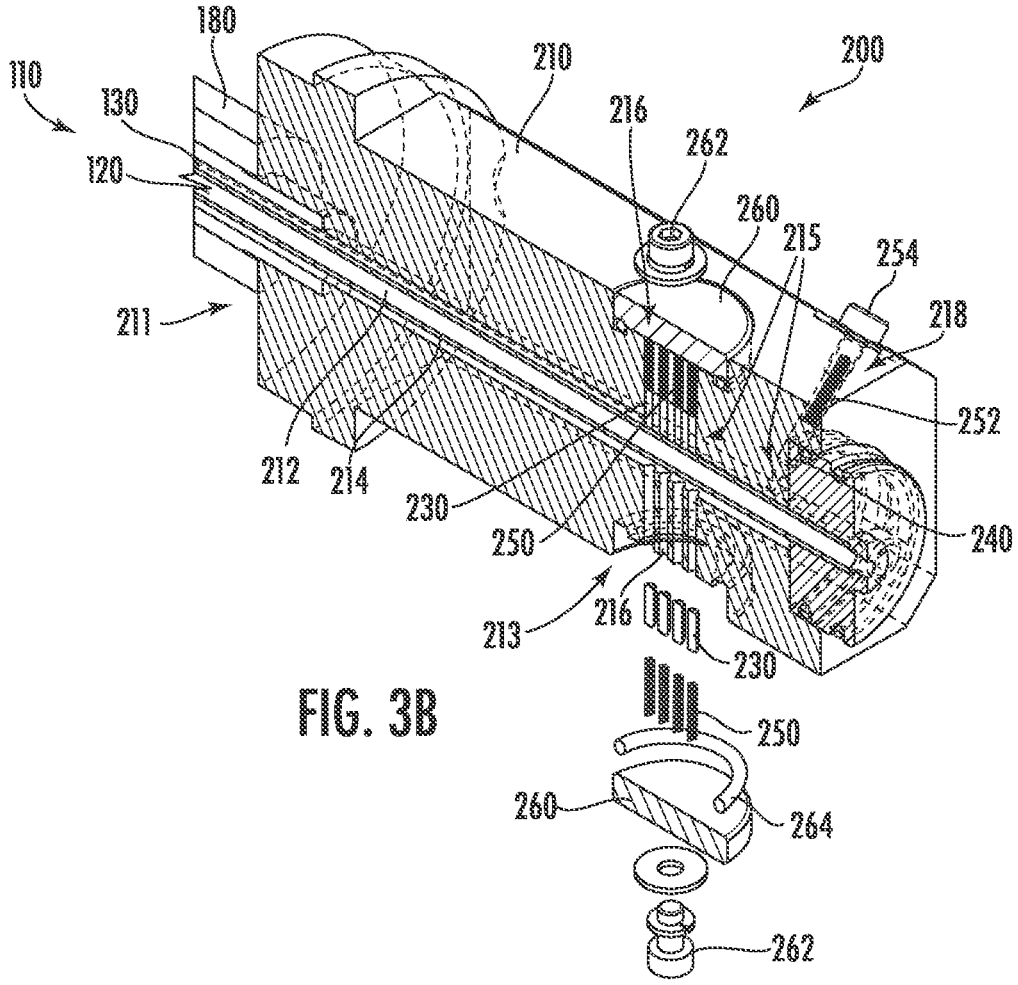
FIG. 3B is an exploded perspective view of a portion of the coaxial waveguide structure of the feed assembly interface of FIG. 3A.

FIGS. 3A and 3B illustrate a feed assembly interface 200 according to embodiments of the present invention. In particular, FIG. 3A is a simplified schematic perspective phantom view of the feed assembly interface 200, and FIG. 3B is a more detailed, exploded perspective view of a central portion of the feed assembly interface 200 of FIG. 3A.

The feed assembly interface 200 may include a feed hub 210 (see FIG. 3B), a pair of waveguide bends such as, for example, J-hook bend waveguides 220-1, 220-2, shorting and/or tuning elements 230, and one or more polarization rotators 240. The feed hub 210 may comprise a metal block (e.g., an aluminum block) that has a central waveguide extension 212 and an outer waveguide extension 214 extending therethrough. The feed hub 210 may be fabricated via, for example, machining, die-casting, 3D printing or additive manufacturing techniques. The outer waveguide extension 214 may circumferentially surround the central waveguide extension 212. The feed hub 210 may include a bore on one end that is sized to receive a base end of the coaxial waveguide structure 110. In the depicted embodiment, the central waveguide extension 212 is simply a rear portion of the central waveguide 120. In other embodiments (not shown), the central waveguide extension 212 may be a separate structure that is, for example, formed in the feed hub 210 that abuts the central waveguide 120 so that high-band signals may pass between the central waveguide extension 212 and the central waveguide 120 with low return loss and low insertion loss. In contrast, in the depicted embodiment, the outer waveguide extension 214 is a separate element from the outer waveguide 130 that is formed in the feed hub 210. The outer waveguide extension 214 may abut the outer waveguide 130 so that low-band signals may pass between the outer waveguide extension 214 and the outer waveguide 130 with return loss and low insertion loss. In other embodiments, the outer waveguide extension 214 may be a rear portion of the outer waveguide 130.

The waveguide bends 220 may be formed as openings extending through the feed hub 210. The wide end of each waveguide bend 220 may be connected to respective first and second ports of a radio by, for example, respective rectangular waveguides (not shown). As shown in FIG. 3A, each waveguide bend 220 comprises a rectangular waveguide that includes a ninety degree bend. The waveguide bends 220 connect to the outer waveguide extension 214. The waveguide bends 220 connect at different points along the longitudinal length of the outer waveguide extension 214. The distal portion of each waveguide bend 220 (i.e., the portion that connects to the outer waveguide extension 214) narrows in cross-sectional height and/or width through a series of matched resonant slots 222. The slots 222 in each waveguide bend 220 may be designed to excite the coaxial TE11 mode in the outer waveguide extension 214 that can be radiated in a linear (vertical) polarization in the outer waveguide extension 214 and passed to the outer waveguide 130.

As shown in FIGS. 3A-3B, a plurality of shorting elements 230 in the form of shorting pins 230 may be inserted into respective openings 216 in the feed hub 210. Each shorting pin 230 may extend through a respective opening 215 in the outer sidewall of the outer waveguide extension 214 and may contact the outer sidewall of the central waveguide extension 212. As shown in FIGS. 3A-3B, a first set of shorting pins 230 are mounted in the top of the feed hub 210 and a second set of shorting pins 230 are mounted in a bottom of the feed hub 210, about 180 degrees around the outer waveguide extension 214 from the first set of shorting pins 230. The shorting pins 230 in each set of shorting pins 230 are aligned in a row, with each row extending in parallel to a longitudinal axis of the central waveguide extension 212. The shorting pins 230 are located along a portion of the outer waveguide extension 214 that is between the locations where the first and second waveguide bends 220 intersect the outer waveguide extension 214.

Additionally, one or more polarization rotators 240 in the form of polarization rotator pins 240 may be provided. The polarization rotator pins 240 may be positioned at a forty-five degree angle with respect to the shorting pins 230, and may extend through the outer waveguide extension 214. The polarization rotator pins 240 may be placed at or about the point along the coaxial feed assembly 100 where the distal end of waveguide bend 220-2 feeds energy into the outer waveguide extension 214. While only a single polarization rotator pin 240 is illustrated in FIGS. 3A-3B, it will be appreciated that an additional polarization rotator pin 240 would typically be provided in the same longitudinal position on the opposite side of the outer waveguide extension 214.

The feed assembly interface 200 of FIGS. 3A-3B may operate as follows. A first vertically polarized microwave signal is fed into the outer waveguide extension 214 through waveguide bend 220-1. The matched resonant slots 222 in the distal portion of waveguide bend 220-1 excite the coaxial TE11 mode in the outer waveguide extension 214 that is radiated in a vertical polarization in the outer waveguide extension 214 and passed to the outer waveguide 130. The shorting pins 230 may block microwave energy associated with this first microwave signal from travelling in the rearward direction toward waveguide bend 220-2, and hence the first microwave signal is transmitted forwardly through the outer waveguide extension 214 and the outer waveguide 130 into the second dielectric block and ultimately to the parabolic reflector 20. A second vertically polarized microwave signal is fed into the outer waveguide extension 214 through waveguide bend 220-2. The matched resonant slots 222 in the distal portion of waveguide bend 220-2 excite the coaxial TE11 mode in the outer waveguide extension 214 that is radiated in a vertical polarization in the outer waveguide extension 214 and passed into the outer waveguide 130. As the microwave signal exits waveguide bend 220-2, the vertically disposed shorting pins 230 direct the microwave signal rearwardly. The polarization rotator pins 240 that are positioned at forty-five degree angles and metal short\end cap\hub act to rotate the polarization of the second microwave signal by ninety degrees to a horizontal polarization, and redirects the microwave energy toward forwardly. The vertically-disposed shorting pins 230 are effectively invisible to the horizontally polarized signal, allowing the horizontally polarized signal to pass in the forward direction. Thus, the feed assembly interface 200 provides a convenient mechanism for feeding two low-band microwave signals into a feed assembly that are transmitted through the feed assembly at orthogonal polarizations.

While not shown in FIG. 3A, other asymmetrical pins and/or small metallic rings can be added to the feed assembly interface 200 to improve the efficiency of the structure. It will also be appreciated that the feed assembly interface 200 is reciprocal so that it can operate in both transmit and receive mode (i.e., it can pass the microwave signals therethrough in either direction).

As described above, the waveguide bends 220 may be used to feed a pair of microwave signals into a feed assembly according to embodiments of the present invention so that the signals travel through the feed assembly at orthogonal polarizations. While not shown in FIG. 3A, the feed assembly interface 200 may also include a conventional rectangular-to-circular waveguide transition. This rectangular-to-circular waveguide transition may be used to connect a high-band radio to the end of the central waveguide extension 212 in order to feed high-band signals into the central waveguide extension 212 where they are passed into the central waveguide 120 of feed assembly 100.

Referring again to FIG. 3B, example designs for the shorting pins 230 and the polarization rotator pins 240 are shown in greater detail. In FIG. 3B, the waveguide bends 220 are omitted to simplify the drawing.

As shown in FIG. 3B, the feed hub 210 includes a circular bore 211 on a first end thereof that receives an end of the coaxial waveguide structure 110. The central waveguide extension 212 and the outer waveguide extension 214 extend longitudinally through the feed hub 210 and are coupled to (or are part of) the central waveguide 120 and the outer waveguide 130, respectively. The feed hub 210 may include a plurality of first channels 216 and a second channel 218. The first channels 216 may extend vertically through the feed hub 210 and may be arranged in two groups, namely a first group that is above the central waveguide extension 212 and a second group that is below the central waveguide extension 212. The first channels 216 in each group may be spaced apart from each other along respective axes that are parallel to a longitudinal axis of the central waveguide extension 212. Each channel 216 may be sized to receive a respective one of the shorting pins 230, as well as an associated biasing element 250 for each respective shorting pin 230. The second channel 218 may extend at a 45 degree angle through the feed hub 210.

Each shorting pin 230 may be inserted into a respective one of the first channels 216. Openings 215 may be provided in the outer wall of the outer waveguide extension 212 at the bottom of each first channel 216. Each shorting pin 230 may extend through a respective one of these openings 215 in the outer wall of the outer waveguide extension 214 so that the shorting pin 230 extends into the outer waveguide extension 214 to contact the outer wall of the central waveguide extension 212. A plurality of biasing elements 250 may be provided that bias each respective shorting pin 230 so that it firmly contacts the outer wall of the central waveguide extension 212 without deforming this outer wall (which may be very thin). The biasing elements 250 may be implemented as a plurality of springs 250 that exert constant loads on each shorting pin 230.

The shorting pins 230 may need to be in close proximity to each other. As a result, in some cases, it may not be possible to use individual screws to hold each shorting pin 230 in place in its respective first channel 216 though the feed hub 210. Consequently, a pair of disks 260 are provided that hold each of the springs 250 in place within the respective channels 216. The disks 260 may be received within respective circular openings 213 in the feed hub 210. Respective screws or bolts 262 may be provided that are used to securely mount the disks 260 in the circular openings 213 in the feed hub 210. Respective O-rings 264 may be provided that act as environmental seals.

As discussed above, the feed assembly interface 200 may also include one or more polarization rotators 240, only one of which is shown in FIG. 3B. The polarization rotators 240 may take the form of metallic pins that are inserted into respective second channels 218. Openings 215 may be provided in the outer wall of the outer waveguide extension 212 at the bottom of each second channel 218. The polarization rotator pins 240 may be inserted into the respective second channels 218 and positioned to extend through the openings 215 in the outer wall of the outer waveguide extension 214 so that the polarization rotating pins 240 extend into the outer waveguide extension 214 to contact the outer wall of the central waveguide extension 212. Biasing elements 252 may be provided that bias the respective polarization rotating pins 240 so that they firmly contact the outer wall of the central waveguide extension 212 without deforming this outer wall. The biasing elements 252 may be implemented as springs 252 that exert constant loads on the respective polarization rotating pins 240. Screws or bolts 254 may be inserted into the respective second channels 218 in order to hold the polarization rotating pins 240 and the springs 252 in place in the respective second channels 218. As is also noted above, while only a single polarization rotator pin 240 is illustrated in FIGS. 3A-3B, an additional polarization rotator pin 240 would typically be provided in the same longitudinal position on the either side of the outer waveguide extension 214. (i.e., 180 degrees offset from the depicted polarization rotator pin 240 so that the channels 218 for the two polarization rotator pins 240 are collinear).

The feed assembly described above with references to FIGS. 3A-3B may be used to feed a single high-band microwave signal to the central waveguide 120 and a pair of cross-polarized low-band microwave signals to the outer waveguide 130. In other embodiments, a pair of cross-polarized high-band microwave signals may be fed to the central waveguide 120. In such embodiments, an OMT may be provided at the input to the central waveguide 120. First and second high-band radio ports (not shown) may be connected to a pair of inputs of the OMT, and may feed first and second orthogonally polarized high band signals to the OMT. The OMT combines the orthogonally polarized signals and feeds them to a rectangular-to-circular wave guide transition that is connected to the central waveguide extension 212 at the base of the feed hub 210. Feed assembly interface 200, which is described above with reference to FIGS. 3A-3B, is effectively an orthomode transducer for the low band frequency allowing the antenna to be fed with a pair of orthogonally polarized signals. As orthomode transducers are well known in the art, further description thereof will be omitted.

Figure 4A:
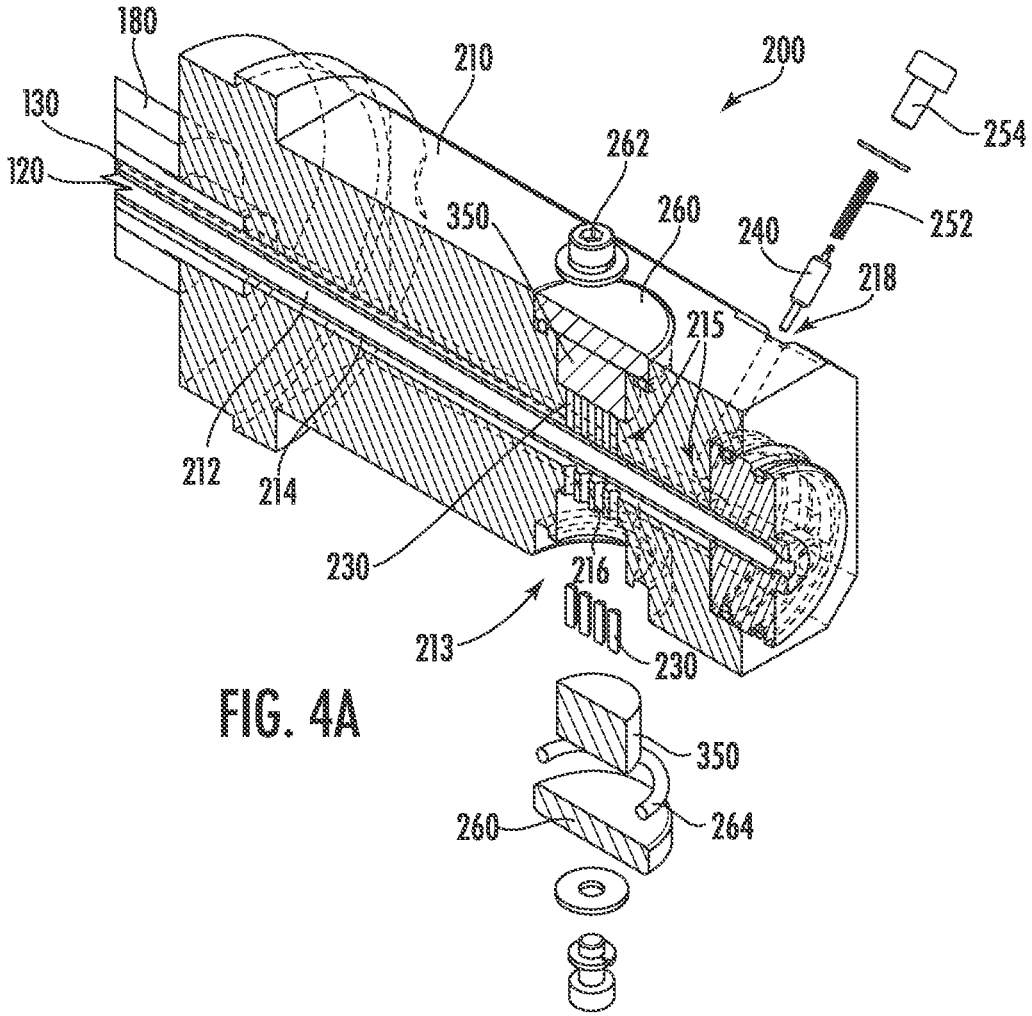
FIG. 4A is an exploded perspective view of a portion of the coaxial waveguide structure of a modified version of the feed assembly interface of FIG. 3A.
Figure 4B:
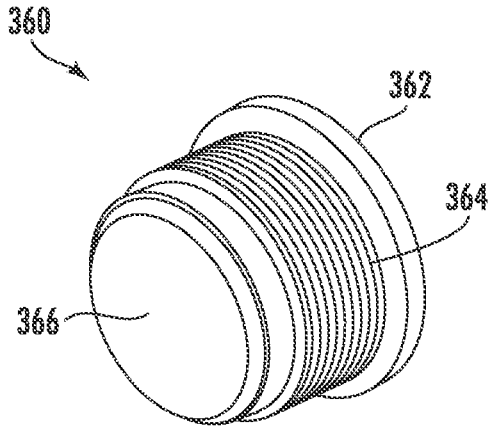
FIG. 4B is an enlarged perspective view of an alternate implementation of the compression block included in the feed assembly interface of FIG. 4A.

FIGS. 4A and 4B illustrate a biasing element according to further embodiments of the present invention that may be used in place of the springs 250 illustrated in FIG. 3B. In particular, FIG. 4A is an exploded perspective view of a central portion of the feed assembly interface 200 of FIG. 3A that illustrates the alternative implementation of the biasing element, while FIG. 4B is an enlarged perspective view of a slightly modified version of the biasing element of FIG. 4A.

As shown in FIG. 4A, each set of springs 250 (see FIG. 3B) may be replaced with a compression block 350. The compression block 350 may be formed of a resilient material so that the compression block 350 exerts a spring force on each of shorting pins 230 in a particular group. The compression block 350 may comprise, for example, a closed cell foam material. The compression block 350 may also act as an environmental seal. The compression block 350 replaces a number of smaller parts with one larger part and thus may be less expensive and/or simplify manufacture of the feed assembly interface 200. The use of the compression block 350 may also reduce the possibility that the channels 216 deviate from a desired location, since the drill depth required to form the channels 216 may be reduced when the compression block 350 is used. The compression block 350 may also potentially allow the O-ring 264 illustrated in FIGS. 3B and 4A to be omitted since the compression block 350 may also act as an environmental seal.

FIG. 4B shows an alternate embodiment in which the compression block 350 and disk 260 are implemented together as a screw-in cap 360. In this embodiment, the disk 260 is replaced with a hollow cap body 362 that has external threads 364. A compression block 366 is inserted into the hollow interior of the cap body 362. The circular bore 213 in the feed hub 210 is formed to have internal threads so that the cap body 362 may be screwed into the bore 213. The bottom of the cap body 362 may have a notch or other feature (not shown) that may facilitate screwing the cap body 362 into the threaded bore 213. This embodiment eliminates the need to provide additional hardware (e.g., a bolt, washers, etc.) for holding the compression block 366 in place and may also provide enhanced environmental protection and/or eliminate the need for an O-ring 264 or other environmental seal. While FIG. 4B depicts an embodiment in which the screw-in cap 360 is a two-piece element including a cap body 362 and a compression block 366, it will be appreciated that in other embodiments a single element cap may be used (which may or may not screw into the opening 213). For example, a rubber disk could potentially be used. A rubber screw/plug, potentially metalized, could be used in place of the screw-in cap 360 in still other embodiments.

Figures 5A, 5B, 5C:
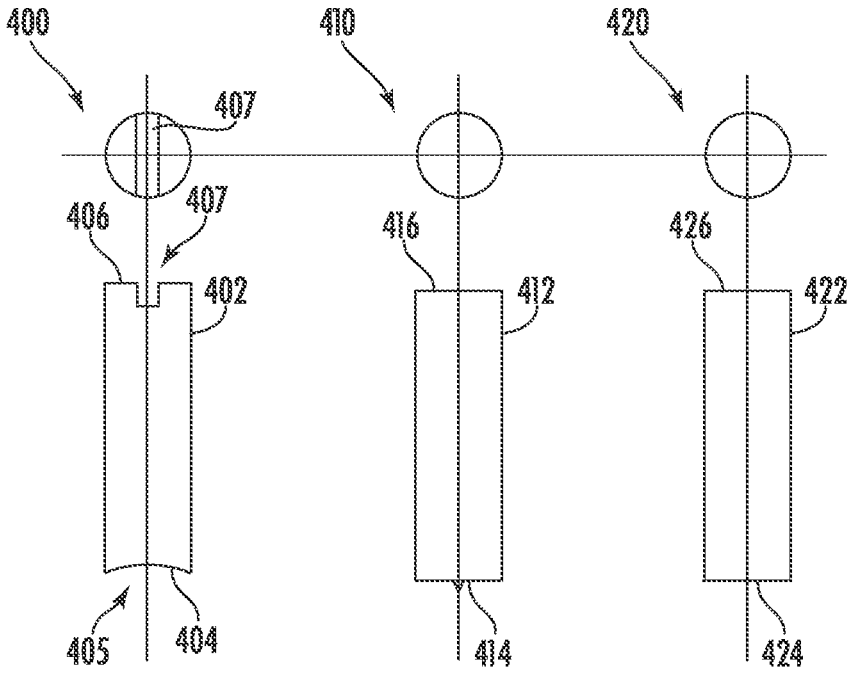
FIGS. 5A-5C are side and end views of three pin designs that may be used in the feed assembly interfaces of FIGS. 3A-4B.

As described above, the feed assembly interfaces according to embodiments of the present invention may include a plurality of shorting pins 230 that are used to selectively block transmission of low-band microwave energy along the outer waveguide extension 214. FIGS. 5A-5C are schematic views of various shorting pins according to embodiments of the present invention.

As shown in FIG. 5A, in some embodiments, shorting pins 400 may be used that take the form of a cylindrical body 402 having first and second ends 404, 406. The first end 404 may have a curved profile 405. The curved profile 405 may be configured to match the curvature of the outer wall of the central waveguide extension 212 so that the entirety of the curved profile may make contact with the outer wall of the central waveguide extension 212. This may provide a good electrical connection between the outer wall of the central waveguide extension 212 and may spread the force applied by the biasing element onto shorting pin 400 over a wider area. A notch or other recess 407 may be provided in the second end 406 of shorting pin 400 that may make it easy to rotate shorting pin 400 either using a tool or by hand so that the curved profile 405 provided on the first end 404 may be rotated into the proper orientation to mate with the outer wall of the central waveguide extension 212. While the embodiment of FIG. 5A depicts a notch 407 in the second end of pin 400, it will be appreciated that in other embodiments a protruding element may be provided instead that may be used to rotate the pin 400.

As shown in FIG. 5B, in other embodiments, shorting pins 410 may be used that again take the form of a cylindrical body 412 having first and second ends 414, 416. The first end 414 may have a small conical protrusion 415 that is configured to contact the outer wall of the central waveguide extension 212. The small conical protrusion 415 may dig into the outer wall of the central waveguide extension 212 without extending therethrough and without deforming the shape of the central waveguide extension 212. The conical projection may provide a good electrical connection between the outer wall of the central waveguide extension 212 and the shorting pin 410. The second end 416 of shorting pin 410 may be flat.

As shown in FIG. 5C, in still other embodiments, shorting pins 420 may be used that have a cylindrical body 422 having first and second ends 424, 426. The first and second ends 424, 426 may be flat ends with no protrusions, recessed, curved profiles or the like. The pins 420 may be very simple to manufacture.

Figure 9:
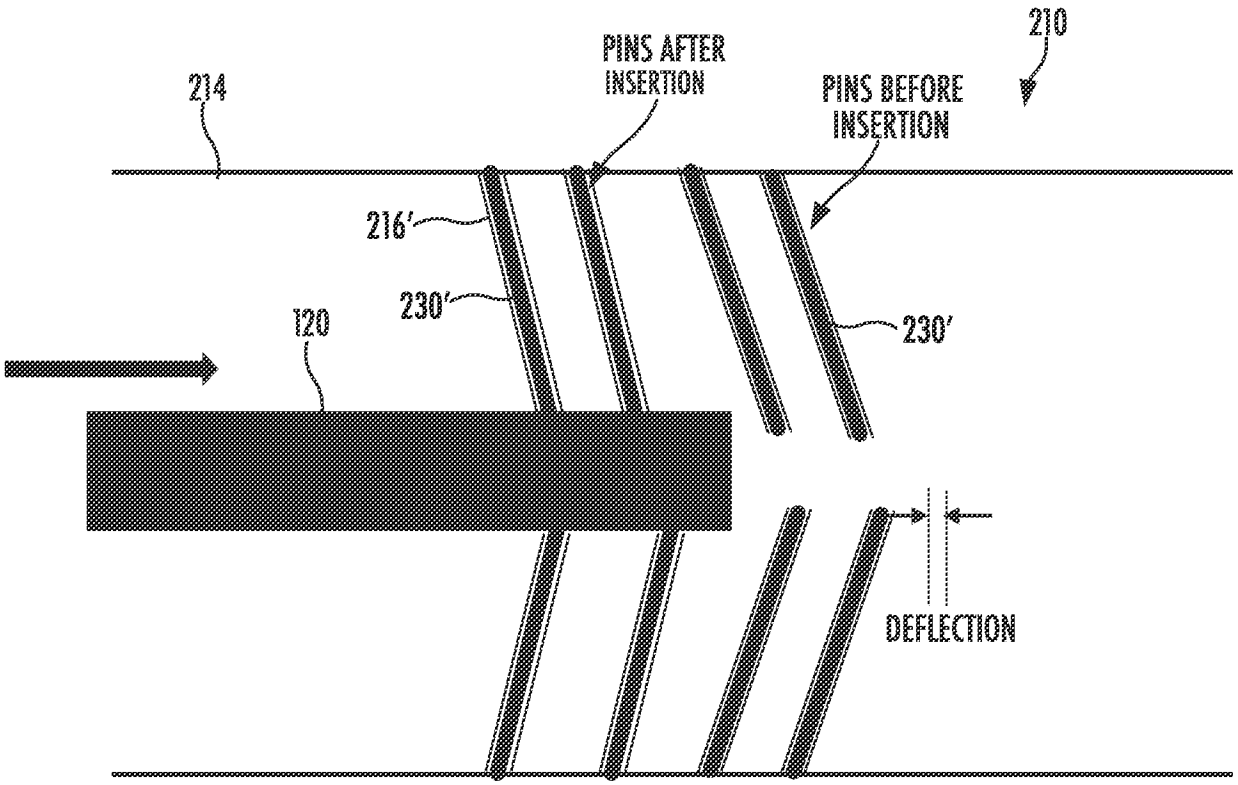
FIG. 9 is a schematic diagram illustrating the angled shorting pins that may be used in the feed assembly interfaces according to embodiments of the present invention.

In still other embodiments, the shorting pins 230 may be angled from the vertical position shown in the figures. FIG. 9 is a schematic diagram illustrating a feed assembly interface that uses such angled shorting pins. As shown in FIG. 9, the shorting pins 230' extend through channels 216' in the feed hub 210 that are angled from the vertical. As noted above, in some cases, the central waveguide extension 212 may simply be a rear portion of the central waveguide 120. In such embodiments, during manufacture, the rear portion of the central waveguide 120 is inserted into the outer waveguide extension 214 of the feed hub 210. The bold arrow in FIG. illustrates the direction of insertion. In the embodiment of FIG. 9, the shorting pins 230' are not only inserted into angled channels 216', but they are also (1) formed of a resilient metal and (2) made slightly longer than the minimum distance necessary to make contact with the outer wall of the central waveguide 120 so that each shorting pin 230' extends into the region where the central waveguide 120 is inserted. As a result, when the central waveguide 120 is inserted into the feed hub 210, the distal ends of the shorting pins 230' are deflected and held firmly against the central waveguide 120 by the spring force of the resilient metal. In embodiments using this approach, the bias members 250 (e.g., the springs) may potentially be omitted, simplifying the design.

It will be appreciated that a wide variety of other shorting elements 230 could be used. For example, blades, screws or dowels could be used in place of the shorting pins 230 described in the above examples. It will also be appreciated that if the feed hub 210 is fabricated by machining, the shorting elements 230 could be formed during the machining process as integral components of the feed hub.

Figure 6:
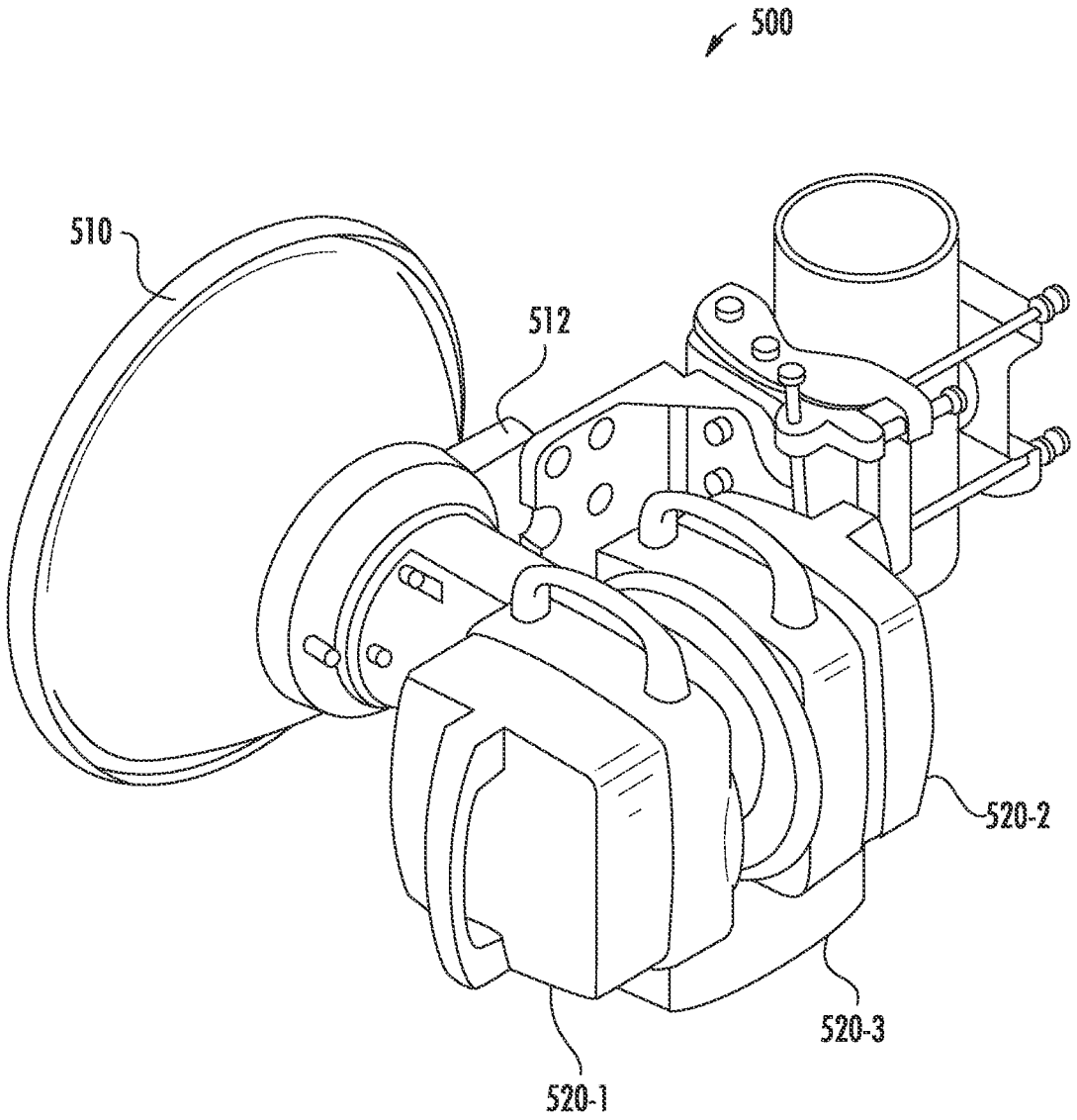
FIG. 6 is a schematic perspective view of a microwave antenna system according to embodiments of the present invention.

FIG. 6 is a schematic perspective view of a microwave antenna system 500 according to embodiments of the present invention that includes a single high-band radio and two orthogonally polarized low-band radios. As shown in FIG. 6, the microwave antenna system 500 includes a parabolic reflector antenna 510 that includes a hub 512, and first and second low-band radios 520-1, 520-2, a high-band radio 520-3. The microwave antenna system 500 may include any of the feed assemblies and/or feed assembly interfaces according to embodiments of the present invention that are described herein.

Figure 8:
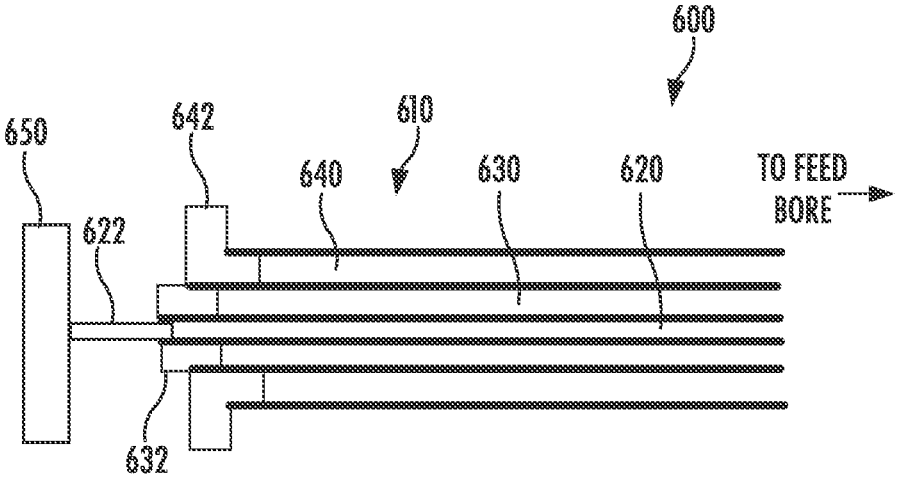
FIG. 8 is a schematic side sectional view of a tri-band feed assembly according to further embodiments of the present invention.

While the discussion above focuses primarily on dual-band microwave antenna systems, it will be appreciated that the concepts described herein may be extended to provide tri-band or even quad-band microwave antenna systems. For example, FIG. 8 schematically depicts a feed assembly 600 that includes a metal (e.g., aluminum) coaxial waveguide structure 610 and a sub-reflector 650. The coaxial waveguide structure 610 includes a central waveguide 620 that may be configured to pass high-band microwave signals, an outer waveguide 640 that circumferentially surrounds the central waveguide 620 that is used to support transmission and reception of low-band microwave signals, and an intermediate waveguide 630 that is positioned between the central waveguide 620 and the outer waveguide 640 that is used to support transmission and reception of "mid-band" microwave signals that are in a frequency range that is between the high-band and the low-band.

The central waveguide 620 may have a generally circular transverse cross-section and may be designed to conduct microwave signals in the basic TE11 mode. The central waveguide 620 may be sized so that it will not support propagation of the low-band or the mid-band microwave signals. The intermediate waveguide 630 and the outer waveguide 640 may each have an annular transverse cross-section. The intermediate waveguide 630 may include, for example, a band-pass filter (not shown) and the outer waveguide 630 may include a low-pass filter (not shown). At least one of the central waveguide 620, the intermediate waveguide 630 and the outer waveguide 640 may extend further from the feed bore 22 of parabolic antenna 20 (or any other suitable parabolic antenna) toward the sub-reflector 650 than do the other two of the central waveguide 620, the intermediate waveguide 630 and the outer waveguide 640. In some embodiments, all three of the central waveguide 620, the intermediate waveguide 630 and the outer waveguide 640 may extend different distances from the feed bore toward the sub-reflector 650. As shown in FIG. 8, in one example embodiment, the central waveguide 620 may extend the farthest from the feed bore toward the sub-reflector 650, the intermediate waveguide 630 may extend the next farthest from the feed bore toward the sub-reflector 650, and the outer waveguide 640 may extend the least distance from the feed bore toward the sub-reflector 650.

The feed assembly 600 further includes first through third dielectric blocks 622, 632, 642. Each of the dielectric blocks 622, 632, 642 may be formed of a low-loss dielectric material. The dielectric blocks 622, 632, 642 are shown schematically in FIG. 8 and are not intended to indicate the actual shapes thereof. The first dielectric block 622 may be mounted in a distal end of the central waveguide 620 and may be impedance matched with the central waveguide 620 so that it efficiently transfers the high-band microwave signals between the central waveguide 620 and the sub-reflector 650. In some embodiments, the first dielectric block 622 may provide a mechanical support for mounting the sub-reflector 650 at an appropriate distance from the distal ends of the waveguides 620, 630, 640. The second dielectric block 632 may be inserted into a distal end of the intermediate waveguide 630 and the third dielectric block 642 may be inserted into a distal end of the outer waveguide 640. The second and third dielectric blocks 632, 642 may be impedance matched with the respective intermediate and outer waveguides 630, 640. The second and/or third dielectric blocks 632, 642 may have body portions that may have annular shapes in some embodiments, and may have annular flanges that extend rearwardly from the body portions that are used to mount the second and third dielectric blocks in the respective intermediate and outer waveguides 630, 640. The central waveguide 620 may extend through both the second and third dielectric blocks 632, 642, and the intermediate waveguide 630 may through the third dielectric block 642.

While a single sub-reflector 650 is depicted in FIG. 8, it will be appreciated that multiple sub-reflectors could alternatively be provided in other embodiments. It will likewise be appreciated feed assembly 600 may be used as a replacement for the feed assembly 100 that is described above. The discussion of the components of feed assembly 100 apply equally to the like components of feed assembly 600.

FIG. 8 illustrates how the concepts disclosed herein may be extended to provide a tri-band feed assembly. The feed assembly interface 200 could likewise be extended to provide a tri-band feed assembly by, for example, repeating the feed assembly interface components for the outer waveguide that are included in feed assembly 200 for the intermediate waveguide. It will likewise be appreciated that the feed assemblies and feed assembly interfaces may further be extended in the exact same fashion to provide quad-band feed assemblies and feed assembly interfaces.

The terminology used herein is for the purpose of describing particular aspects only and is not intended to be limiting of the disclosure. As used herein, the singular forms "a", "an" and "the" are intended to include the plural forms as well, unless the context clearly indicates otherwise. It will be further understood that the terms "comprises" and/or "comprising," when used in this specification, specify the presence of stated operations, elements, and/or components, but do not preclude the presence or addition of one or more other operations, elements, components, and/or groups thereof. As used herein, the term "and/or" includes any and all combinations of one or more of the associated listed items. Like reference numbers signify like elements throughout the description of the figures.

The thicknesses of elements in the drawings may be exaggerated for the sake of clarity. Further, it will be understood that when an element is referred to as being "on," "coupled to" or "connected to" another element, the element may be formed directly on, coupled to or connected to the other element, or there may be one or more intervening elements therebetween.

Terms such as "top," "bottom," "upper," "lower," "above," "below," and the like are used herein to describe the relative positions of elements or features. For example, when an upper part of a drawing is referred to as a "top" and a lower part of a drawing is referred to as a "bottom" for the sake of convenience, in practice, the "top" may also be called a "bottom" and the "bottom" may also be a "top" without departing from the teachings of the inventive concept.

It will be understood that, although the terms "first," "second," etc. may be used herein to describe various elements, these elements should not be limited by these terms. These terms are only used to distinguish one element from another. Thus, a first element could be termed a second element without departing from the teachings of the inventive concept.

Unless otherwise defined, all terms (including technical and scientific terms) used herein have the same meaning as commonly understood by one of ordinary skill in the art to which this inventive concept belongs. It will be further understood that terms, such as those defined in commonly used dictionaries, should be interpreted as having a meaning that is consistent with their meaning in the context of the relevant art and this specification and will not be interpreted in an idealized or overly formal sense unless expressly so defined herein.

The description of the present disclosure has been presented for purposes of illustration and description, but is not intended to be exhaustive or limited to the disclosure in the form disclosed. Many modifications and variations will be apparent to those of ordinary skill in the art without departing from the scope and spirit of the disclosure. The aspects of the disclosure herein were chosen and described in order to best explain the principles of the disclosure and the practical application, and to enable others of ordinary skill in the art to understand the disclosure with various modifications as are suited to the particular use contemplated.

What is claimed is:

1. A microwave antenna system, comprising:

a parabolic reflector antenna having a feed bore;

a feed assembly that includes a coaxial waveguide structure that extends in a longitudinal direction, the coaxial waveguide structure including a central waveguide and an outer waveguide that circumferentially surrounds the central waveguide; and a feed assembly interface that includes:

a central waveguide extension;

an outer waveguide extension;

a first rectangular waveguide;

a second rectangular waveguide, the first and second rectangular waveguides coupled to the outer waveguide extension at respective first and second longitudinal positions along the outer waveguide extension; and a plurality of shorting elements that extend through respective openings in the outer waveguide extension to contact an outer surface of the central waveguide extension, the shorting elements disposed between the first and second longitudinal positions; and at least one biasing element that biases the shorting elements against an outer wall of the central waveguide extension.

2. The microwave antenna system of claim 1, wherein the shorting elements comprise a plurality of pins.

3. The microwave antenna system of claim 2, wherein the at least one biasing element comprises a plurality of springs.

4. The microwave antenna system of claim 3, wherein a separate spring is provided for each pin.

5. The microwave antenna system of claim 2, wherein the at least one biasing element comprises a compression block.

6. The microwave antenna system of claim 1, the feed assembly interface further comprising a polarization rotator that extends into the outer waveguide extension.

7. The microwave antenna system of claim 6, wherein the polarization rotator comprises an angled pin that is angled with respect to the shorting elements.

8. The microwave antenna system of claim 7, wherein the angled pin is angled at a 45 degree angle with respect to a horizontal plane defined by the bottom of the first rectangular waveguide.

9. The microwave antenna system of claim 7, the feed assembly interface further comprising a polarization rotator biasing element that biases the angled pin against the central waveguide extension.

10. The microwave antenna system of claim 7, wherein one of the central waveguide and the outer waveguide extends further from the feed bore towards a sub-reflector than the other of the central waveguide and the outer waveguide.

11. The microwave antenna system of claim 10, wherein the central waveguide extends further from the feed bore towards the sub-reflector than the outer waveguide.

12. The microwave antenna system of claim 11, the feed assembly further comprising a first dielectric block that is mounted in a distal end of the central waveguide, the sub-reflector, and a second dielectric block that is positioned between the coaxial waveguide structure and the sub-reflector.

13. The microwave antenna system of claim 12, wherein the second dielectric block is mounted in a distal end of the outer waveguide, the second dielectric block includes a central opening, and the central waveguide extends through the central opening in the second dielectric block.

14. A microwave antenna system, comprising:

a parabolic reflector antenna;

a feed assembly interface that extends in a longitudinal direction, the feed assembly interface including:

a central waveguide structure;

an outer waveguide structure that circumferentially surrounds the central waveguide structure;

first and second waveguides that are coupled to the outer waveguide structure at respective first and second longitudinal positions along the outer waveguide structure; and a plurality of pins that extend through respective openings in the outer waveguide structure to contact an outer surface of the central waveguide structure, the pins disposed between the first and second longitudinal positions; and at least one biasing element that biases the pins against an outer wall of the central waveguide structure.

15. The microwave antenna system of claim 14, wherein the at least one biasing element comprises a compression block.

16. The microwave antenna system of claim 14, wherein the at least one biasing element comprises a plurality of springs.

17. The microwave antenna system of claim 16, the feed assembly interface further comprising a polarization rotator that extends into the outer waveguide structure.

18. The microwave antenna system of claim 17, wherein the polarization rotator comprises an angled pin that is angled with respect to the pins comprising the plurality of pins.

19. The microwave antenna system of claim 18, the feed assembly interface further comprising a polarization rotator biasing element that biases the angled pin against the central waveguide structure.

20. The microwave antenna system of claim 19, wherein the angled pin is angled at a 45 degree angle with respect to a horizontal plane defined by the bottom of the first waveguide.

* * * * *